US007869738B2

(12) United States Patent
Takemoto

(10) Patent No.: US 7,869,738 B2
(45) Date of Patent: Jan. 11, 2011

(54) IMAGE FORMING APPARATUS

(75) Inventor: Hideyuki Takemoto, Chigasaki (JP)

(73) Assignee: Ricoh Company, Ltd., Tokyo (JP)

( * ) Notice: Subject to any disclaimer, the term of this patent is extended or adjusted under 35 U.S.C. 154(b) by 120 days.

(21) Appl. No.: 12/289,565

(22) Filed: Oct. 30, 2008

(65) Prior Publication Data

US 2009/0123175 A1 May 14, 2009

(30) Foreign Application Priority Data

Nov. 9, 2007 (JP) ..... 2007-292254

(51) Int. Cl.
*G03G 15/00* (2006.01)

(52) U.S. Cl. ..... 399/107

(58) Field of Classification Search ..... 399/107, 399/110, 114, 124, 397, 401
See application file for complete search history.

(56) References Cited

U.S. PATENT DOCUMENTS

| | | | | |
|---|---|---|---|---|
| 5,949,924 | A | 9/1999 | Noguchi et al. | |
| 6,023,538 | A | 2/2000 | Noguchi et al. | |
| 6,078,703 | A | 6/2000 | Noguchi et al. | |
| 6,122,412 | A | 9/2000 | Noguchi et al. | |
| 6,546,228 | B2 | 4/2003 | Motohashi et al. | |
| 6,690,901 | B2 | 2/2004 | Katsuyama et al. | |
| 6,985,265 | B2 * | 1/2006 | Ito | 358/400 |
| 7,177,573 | B2 | 2/2007 | Kimura et al. | |
| 7,181,157 | B2 * | 2/2007 | Nanno | 399/401 |
| 7,302,204 | B2 | 11/2007 | Katsuyama et al. | |
| 2002/0150403 | A1 | 10/2002 | Katsuyama et al. | |
| 2004/0114958 | A1 | 6/2004 | Katsuyama et al. | |
| 2004/0234296 | A1 | 11/2004 | Kimura et al. | |

FOREIGN PATENT DOCUMENTS

| | | |
|---|---|---|
| JP | 07-261620 | 10/1995 |
| JP | 2005-091946 | 4/2005 |
| JP | 2006-106280 | 4/2006 |

* cited by examiner

*Primary Examiner*—Hoan Tran
(74) *Attorney, Agent, or Firm*—Harness, Dickey & Pierce, P.L.C.

(57) ABSTRACT

An image forming apparatus includes a main body housing including a plurality of walls, a duplex unit openably provided to one of the walls of the main body housing, that reverses a recording medium, and a handle that advances from and retracts to the wall of the main body housing including the duplex unit. The duplex unit includes a pocket which is a clearance formed in the advancing/retracting direction and a direction perpendicular to and adjoining the advancing/retracting direction of the handle so as to expose the handle inside the duplex unit. A front end of the handle in the advancing direction thereof is positioned at a retracted position when the handle is retracted to the pocket and positioned at an advanced position outside the duplex unit when the handle is pulled out from the retracted position.

12 Claims, 14 Drawing Sheets

IMAGE FORMING APPARATUS

CROSS-REFERENCE TO RELATED APPLICATIONS

This patent application is based on and claims priority pursuant to 35 U.S.C. §119 from Japanese Patent Application No. 2007-292254 filed on Nov. 9, 2007 in the Japan Patent Office, the entire contents of which are hereby incorporated herein by reference.

BACKGROUND OF THE INVENTION

1. Field of the Invention

Exemplary aspects of the present invention generally relate to an image forming apparatus, and more particularly, to an image forming apparatus that includes handles for facilitating transport of the image forming apparatus.

2. Description of the Background Art

An image forming apparatus, such as a printer, a facsimile machine, a copier, a multi-functional system including any combination thereof is known. Such an image forming apparatus is equipped with an image forming unit dedicated to performing image formation.

Upon installation and/or maintenance, the image forming apparatus may have to be moved to a different location. In general, the image forming apparatus tends to be relatively heavy, so that handles are commonly provided thereto to facilitate transport of the image forming apparatus.

Such handles include one that is provided to a wall of a main body housing of the image forming apparatus and can be folded in and out from its original position upon transport.

Another known handle is provided such that the handle can be pulled out from inside the main body housing to outside thereof and retracted to its storage position inside the main body housing.

The latter type of the handle is disclosed in JP-2005-91946-A, for example. This type of handle is provided such that the handle can be pulled out from and retracted to its storage position in a slanting manner at a predetermined angle relative to the wall of the image forming apparatus.

Further, in another known method according to JP-2006-106280-A, a handle may be pulled out from and retracted to its storage position vertically relative to the wall of the main body housing.

Generally, the image forming apparatus include components such as image forming devices and waste toner bottles that need to be discarded or replaced with a new one at the proper time. Thus, as disclosed in JP-H07-261620-A, in order to facilitate maintenance of these components to be replaced or discarded, these components are usually disposed in a front side of the image forming apparatus so that an operator can perform maintenance with ease.

At the same time, reduction in overall size is expected of the image forming apparatus because installation space for the image forming apparatus in offices is often limited. Consequently, components are most likely to be arranged close to each other in the image forming apparatus, and thus it is often the case that it is difficult to provide extra space for those parts, such as the handle for transport, that are not directly associated with image forming operations.

When the handle that facilitates transport of the image forming apparatus is provided therein, it is desirable that a length by which the handle can be pulled out from the main body housing be relatively large so as to reduce the weight load on the operator due to moment of the length.

When, for example, a duplex unit (or a sheet reverse unit) that reverses a recording sheet on which an image has been printed on one side is provided to the wall of the image forming apparatus, that is, the same wall on which the handle is provided, the amount by which the handle can be pulled out needs to be greater than an amount by which the duplex unit projects.

In such a case, the handle needs to be relatively long, necessitating a larger space for accommodating the handle in the image forming apparatus.

According to the related art approach disclosed in JP-2005-91946-A, there is a problem in that the size of image forming apparatus is difficult to reduce, because, in addition to an advancing/retracting space on a horizontal plane, a space in a lateral direction allowing the handle to move obliquely is also needed, thereby complicating efforts to make the image forming apparatus as a whole as compact as is usually desired.

By contrast, according to JP-2006-106280-A, the handle advances and retracts at substantially the bottom of the duplex unit in the direction perpendicular to the width direction of the duplex unit that covers substantially an entire surface of the wall of the main body housing in the width direction thereof.

However, with this configuration, the operator needs to bend his or her back in order to pull out and retract the handle from substantially the bottom of the duplex unit which is generally tall in height, thereby complicating transport of the image forming apparatus for the operator.

Further, when the parts or devices that need to be replaced or discarded are disposed substantially at the front side of the image forming apparatus, that is, the side facing the operator, the handle may interfere with the parts or devices including image forming devices if the handle is provided to the front side of the image forming apparatus, thereby complicating efforts to secure the installation space for the handle.

In particular, when the image forming apparatus is equipped with the duplex unit, the wall of the main body housing at which the duplex unit is disposed weighs more than the wall without the duplex unit. Thus, it is desirable to install the handle in such a way that the handle can reliably support the weight of the duplex unit.

However, as described above, the installation location for the handle must not interfere with replacement or disposal of the parts or devices installed at the front side of the image forming apparatus.

When the image forming apparatus includes the duplex unit, generally, the duplex unit is detachably provided relative to the wall of the main body housing so as to solve problems such as paper jams in the duplex unit. For example, according to JP-2006-106280-A, the duplex unit is openable about a shaft provided at a lower part of the main body housing in the direction of the height thereof. With this structure, in which the handle is provided in the vicinity of the lower part of the duplex unit, the operator can still hold the handle even if the duplex unit is opened.

However, in a case in which the amount by which the handle is pulled out from the main body housing is configured based on an assumption that the handle is pulled out when the duplex unit is closed, when a problem occurs and the duplex unit needs to be moved while the duplex unit is opened, the weight balance, in particular, the weight balance of the side at which the duplex unit is disposed will be different from the initial weight balance when the duplex unit is closed, thereby causing too much stress on the handle and possible damage to the handle.

In addition, when the duplex unit is accidentally opened and closed due to shock during transport of the image forming apparatus, the duplex unit may accidentally hit a hand of the operator, thereby preventing smooth transport operation.

As described above, the handles bear substantially an entire weight of the image forming apparatus. Consequently, during transport of the image forming apparatus, the handles may deform due to the weight. Thus, it is desirable that the handle have a rigid structure.

However, when the handle has a solid cross section in order to increase sectional stiffness thereof, the weight load of the handle itself increases, thereby necessitating the main body housing to have a rigid structure that can facilitate the weight load of the handle, and thus complicating the configuration and increasing the weight of the image forming apparatus as a whole.

SUMMARY OF THE INVENTION

Illustrative embodiments of the present invention provide an image forming apparatus that facilitates transport of the image forming apparatus.

According to one preferred embodiment, the image forming apparatus includes an image bearing member, a charging unit, a developing unit, a transfer unit, a main body housing, a duplex unit, and a handle. The image bearing member is configured to bear a latent image on a surface thereof. The charging unit is configured to charge the image bearing member. The developing unit is configured to supply toner to the latent image so as to develop the latent image. The transfer unit is configured to transfer the toner image onto a transfer medium. The main body housing includes a plurality of walls. The duplex unit is openably and closably provided to one of the walls of the main body housing and is configured to reverse a recording medium. The handle is configured to advance from and retract to the wall of the main body housing including the duplex unit. The duplex unit includes a pocket which is a clearance formed in the advancing/retracting direction and a direction perpendicular to and adjoining the advancing/retracting direction of the handle so as to expose the handle inside the duplex unit. A front end of the handle in the advancing direction thereof is configured to be positioned at a retracted position in the pocket when the handle is retracted to the pocket and positioned at an advanced position outside the duplex unit when the handle is pulled out from the retracted position.

Additional features and advantages of the present invention will be more fully apparent from the following detailed description of illustrative embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description of illustrative embodiments when considered in connection with the accompanying drawings, wherein.

DETAILED DESCRIPTION OF ILLUSTRATIVE EMBODIMENTS

Figure 1:
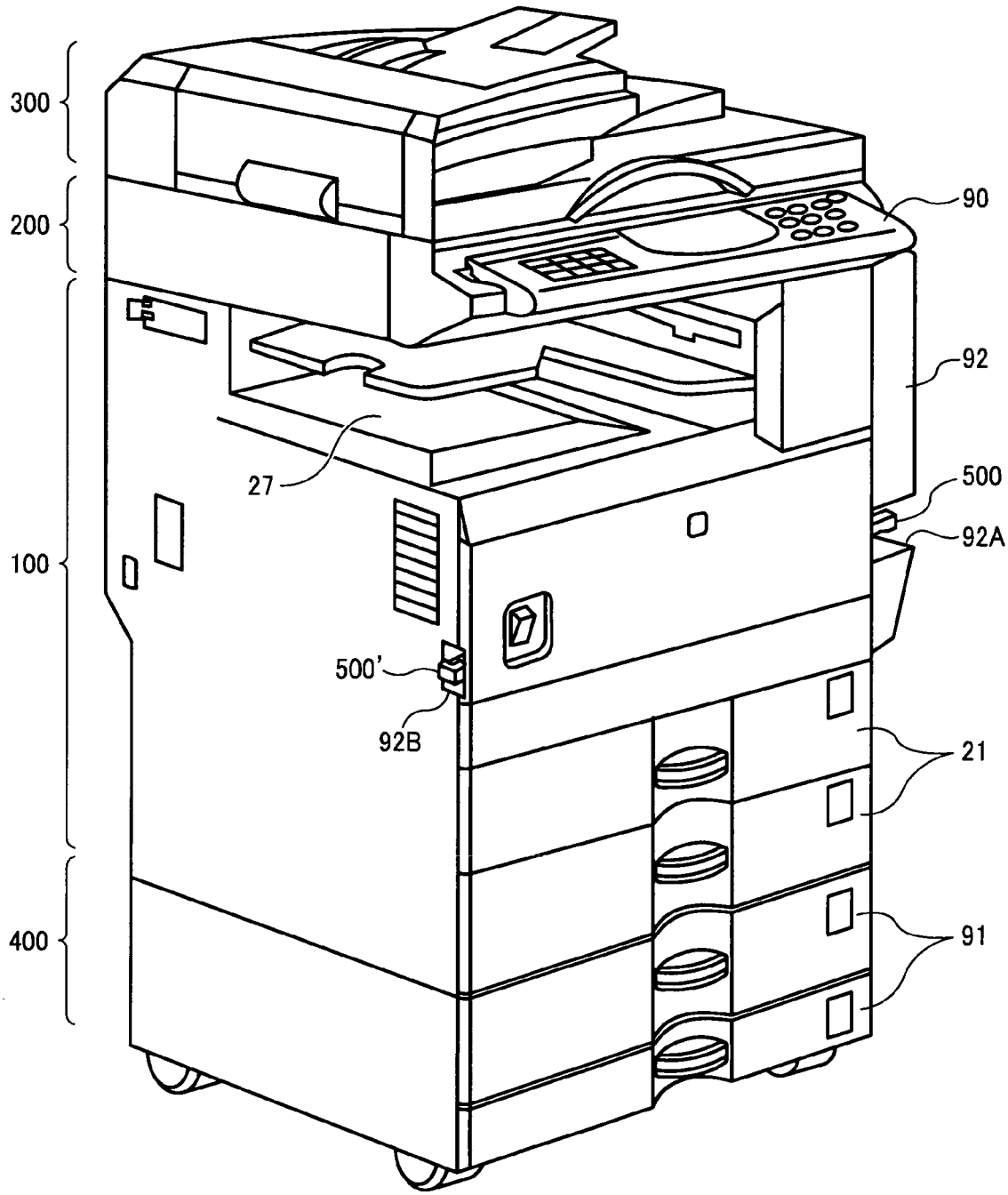
FIG. 1 is an external view of a multi-functional system as an example of an image forming apparatus according to an illustrative embodiment of the present invention.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Illustrative embodiments of the present invention are now described below with reference to the accompanying drawings.

In a later-described comparative example, illustrative embodiment, and alternative example, for the sake of simplicity of drawings and descriptions, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included.

Thus, solely for simplicity, although this Detailed Description section refers to paper, sheets thereof, paper feeder, etc., it should be understood that the sheets, etc., are not limited only to paper, but includes other printable media as well.

Referring now to the drawings, wherein like reference numerals designate identical or corresponding parts throughout the several views, and initially to FIG. 1, one example of an image forming apparatus, for example, a tandem-type electrophotographic color image forming apparatus, according to an illustrative embodiment of the present invention is described.

FIG. 1 is an external view illustrating a tandem-type electrophotographic color image forming apparatus (hereinafter simply referred to as an image forming apparatus) in which four image forming stations that form images in different colors are arranged in tandem in a stretched direction of a transfer belt. The images in different colors formed by the image forming stations are overlappingly transferred onto the transfer belt.

It is to be noted that the image forming apparatus according to the present invention may serve as a multi-functional system including a copier, a printer, a facsimile machine, or any combination thereof.

In FIG. 1, the image forming apparatus includes an image reading unit 200 disposed above the image forming apparatus main body 100. The image reading unit 200 includes a contact glass on an upper surface thereof and an operation display unit 90 that projects to the front side of the image reading unit 200.

Substantially above the image reading unit 200, an automatic document feeder (hereinafter simply referred to as an ADF) 300 is openably/closably provided about a support shaft at the back thereof so that the front side of the ADF can be opened and closed.

As illustrated in FIG. 1, the image forming apparatus main body 100 equipped with the image reading unit 200 and the ADF 300 also includes an optional sheet feed unit 400. It is to be noted that the optional sheet feed unit 400 is only optional. Thus, the image forming apparatus 100 may not have to include the optional sheet feed unit 400.

The optional sheet feed unit 400 includes a sheet cassette 91 including two sheet feed trays, each of which is drawable to the front of the image forming apparatus 100.

At the right side of the image forming apparatus main body 100, a duplex unit or a sheet reverse unit 92 constitutes one of the side walls of a main body housing of the image forming apparatus 100 and is pivotally movable about a support shaft, not illustrated, at the bottom of the duplex unit 92 in the vertical direction thereof so that the upper portion of the duplex unit 92 can be opened pivotally when paper jams or the like occur in the duplex unit 92.

Figure 2:
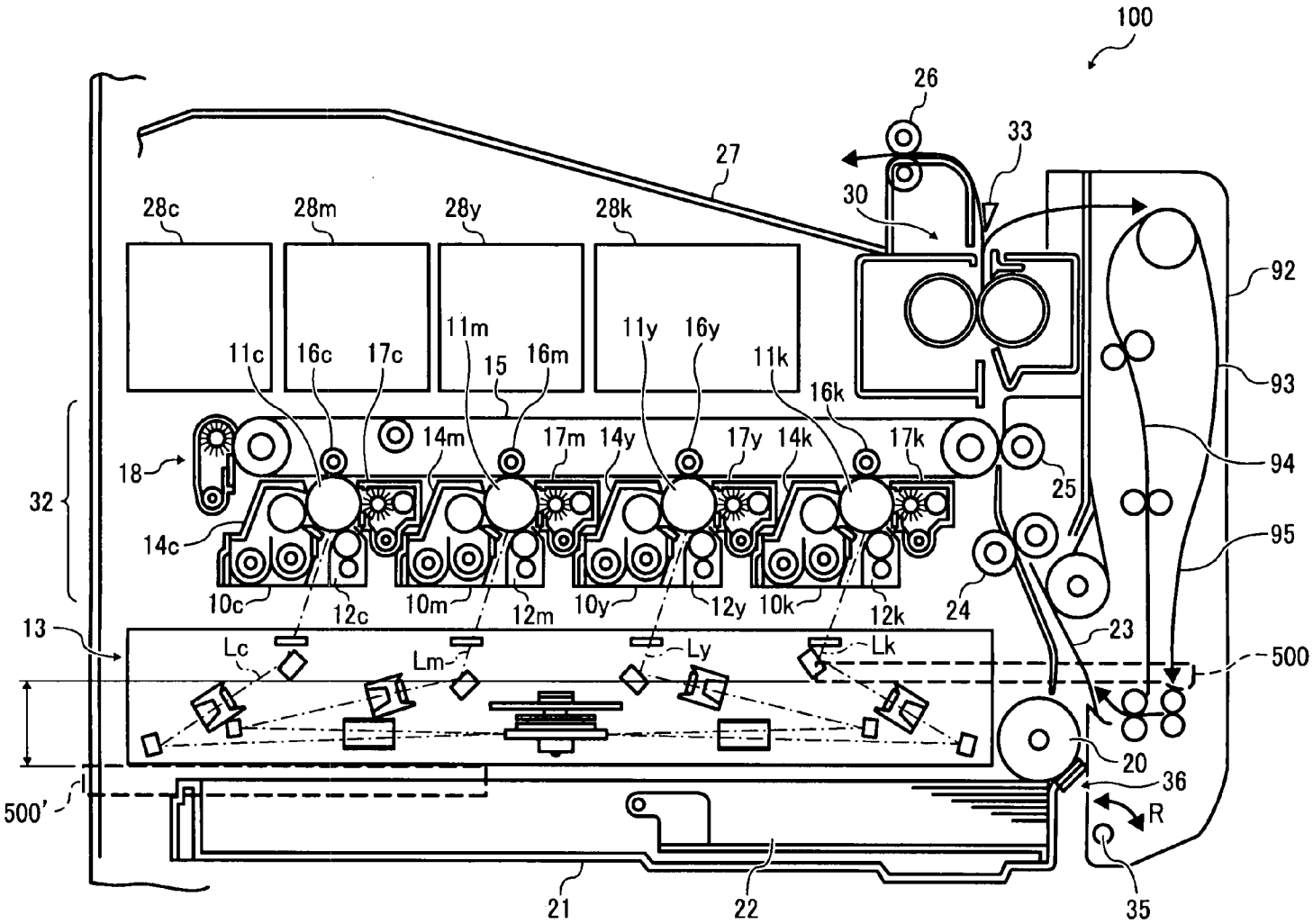
FIG. 2 is a schematic diagram illustrating the image forming apparatus of FIG. 1 according to an illustrative embodiment of the present invention.

Referring now to FIG. 2, there is provided a schematic diagram illustrating the internal structure of the image forming apparatus main body 100, according to the illustrative embodiment. It is to be noted that the image reading unit 200, the ADF 300, and the optional sheet feed unit 400 illustrated in FIG. 1 are omitted in FIG. 2.

In FIG. 2, the image forming apparatus main body 100 includes four image forming stations 10*c*, 10*m*, 10*y*, and 10*b* to form images in cyan, magenta, yellow, and black, respectively. The image forming stations 10*c*, 10*m*, 10*y*, and 10*b* are arranged in tandem.

According to the illustrative embodiment, the tandem-type full-color image forming apparatus is employed. However, the present invention is not limited to the tandem-type image forming apparatus. It is to be noted that the present invention may be applied to other types of image forming apparatuses, such as a revolver-type image forming apparatus in which the image forming stations for forming a full-color image are sequentially rotated and faced to a transfer portion, and a tandem-type monochrome image forming apparatus for producing a monochrome image.

It is to be noted that reference characters y, m, c, and k denote colors of yellow, magenta, cyan and black, respectively.

The image forming stations 10*c*, 10*m*, 10*y*, and 10*b* include a drum-type image bearing members 11*c*, 11*m*, 11*y*, and 11*b*, respectively. Each of the image bearing members 11*c*, 11*m*, 11*y*, and 11*b* rotates in a clockwise direction while being charged by charging devices 12*c*, 12*m*, 12*y*, and 12*b*.

Subsequently, an optical writing device 13 illuminates the image bearing members 11*c*, 11*m*, 11*y*, and 11*b* with laser beams Lc, Lm, Ly, and Lb, respectively based on image signals.

After that, developing devices 14*c*, 14*m*, 14*y*, and 14*b* supply respective color of toners to latent images formed on the image bearing members 11*c*, 11*m*, 11*y*, and 11*b* so as to form toner images or visible images of respective colors thereon.

When a transfer bias is applied by primary transfer devices 16*c*, 16*m*, 16*y*, and 16*k*, the toner images in cyan, magenta, yellow, and black formed on the image bearing members 11*c*, 11*m*, 11*y*, and 11*b* of the image forming stations 10*c*, 10*m*, 10*y*, and 10*b* are sequentially and overlappingly transferred onto a belt-type intermediate transfer medium 15 facing the image bearing members 11*c*, 11*m*, 11*y*, and 11*b*, thereby forming a full-color composite toner image.

The intermediate transfer medium 15 is made of an endless belt and stretched by rollers.

In an appropriate timing, one of sheet feed rollers 20 is selectively rotated so as to pick up a paper sheet (recording medium) 22 from a sheet cassette 21 the image forming apparatus 100 or from the sheet cassette 91 of the optional sheet feed unit 400 illustrated in FIG. 1.

Subsequently, the paper sheet 22 is transported through a sheet conveyance path 23 or a recording medium conveyance path and arrives at a pair of registration rollers 24 that then feeds the paper sheet 22 to a secondary transfer device 25 in an appropriate timing such that the paper sheet 22 is aligned with the full-color composite toner image formed on the intermediate transfer medium 15.

The secondary transfer device 25 transfers secondarily the composite toner image onto the paper sheet 22 by applying the transfer bias. After the secondary transfer process, the paper sheet 22, onto which the composite toner image is transferred, passes the sheet conveyance path 23 and arrives at a fixing nip between two rollers of a fixing device 30.

When the paper sheet 22 passes the fixing nip, heat and pressure are applied thereto so that the toner on the paper sheet 22 is fused and fixed thereon. Subsequently, the paper sheet 22 is discharged onto a catch tray 27 provided on the image forming apparatus main body 100 by a discharge roller 26. Toner cartridges 28*c*, 28*m*, 28*y*, and 28*k* are provided substantially below the catch tray 27.

After the primary transfer, foreign substances such as paper dust and toner (residual toner) remaining on the image bearing members 11*c*, 11*m*, 11*y*, and 11*b* are cleaned by primary cleaning devices 17*c*, 17*m*, 17*y*, and 17*b*, respectively.

After the secondary transfer, the residual toner is removed from the intermediate transfer member 15 by a secondary cleaning device 18.

When duplex printing is performed on the paper sheet, that is, when an image is printed on the other side of the paper sheet 22 after the secondary transfer, a switching claw 33 is configured to switch the direction of transport of the paper sheet 22 to the duplex unit 92 after the paper sheet 22 passes the fixing device 30.

An image forming portion 32 includes the image forming stations 10*c*, 10*m*, 10*y*, and 10*k*, the intermediate transfer medium 15, the secondary cleaning device 18, and so forth.

The duplex unit 92 includes a switchback path 93 and a sheet feed path 94. In order to form images on both sides of the paper sheet 22, the paper sheet 22 is turned upside down in the switchback path 93 in the duplex unit 92 in preparation for the secondary transfer.

In the duplex unit 92, the paper sheet 22 is turned over and sent again to the pair of the registration rollers 24 of the image forming apparatus main body 100 through the sheet feed path 94 of the duplex unit 92.

Subsequently, the paper sheet 22 is subjected to the secondary transfer process again in the appropriate timing of the pair of,the registration rollers 24.

It is to be noted that the duplex unit 92 is pivotally movable about a support shaft 35 in a direction of arrow R in FIG. 2 so that the duplex unit 92 can be pivotally opened, exposing the sheet feed path 94 and a sheet feeding portion 36, when paper jams or the like occur in the duplex unit 92. A switchback path 95 is provided to the duplex unit 92.

Next, a description will be provided of a distinctive feature of the exemplary aspects of the present invention. According to one illustrative embodiment, an installation space required for a handle that advances and retracts relative to the main body housing of the image forming apparatus is reduced effectively.

Figure 3:
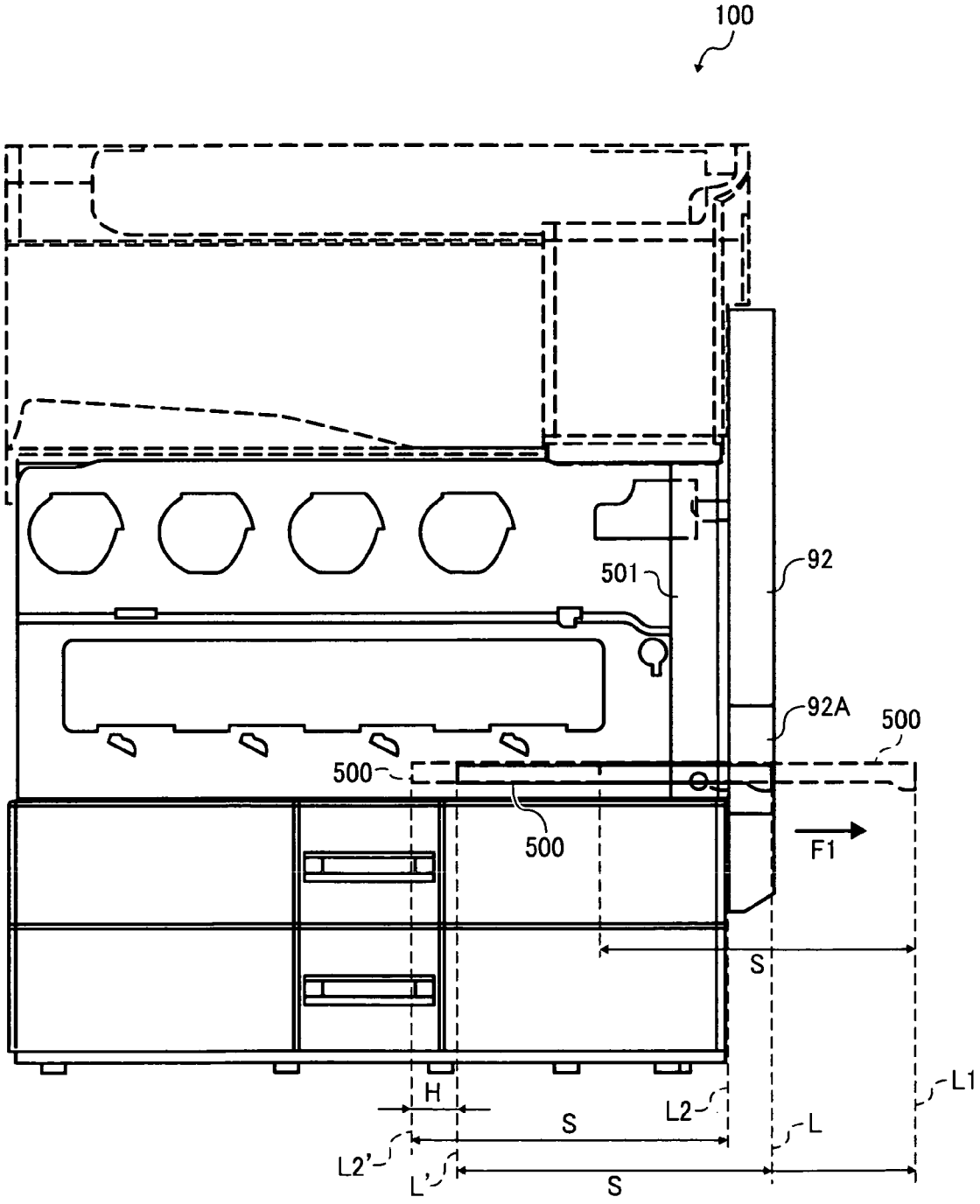
FIG. 3 is a schematic diagram conceptually illustrating the image forming apparatus when exterior covers thereof are removed according to an illustrative embodiment of the present invention.

Referring now to FIG. 3, there is provided a conceptual diagram illustrating an internal configuration of the image forming apparatus main body 100 when exterior covers are removed.

In FIG. 3, one of the side walls constituting the housing of the image forming apparatus main body 100 includes the duplex unit 92 that is openable relative to the side wall. The duplex unit 92 includes a pocket 92A configured to expose a handle 500 capable of being-moved forward and backward relative to the wall of the image forming apparatus main body 100 in a direction of arrow F1.

The advancing/retracting direction of the handle 500 is equivalent to a direction parallel to a direction in which the duplex unit 92 is opened and closed (hereinafter referred to as an open/close direction of the duplex unit 92).

The pocket 92A is a clearance in the advancing/retracting direction of the handle 500 as well as a direction substantially perpendicular to and adjoining the advancing/retracting direction. The pocket 92A contains the handle 500 configured to advance from and retract to the wall of the main body housing.

As illustrated in FIG. 3, a front end of the handle 500 in the advancing direction thereof, that is, the direction of arrow F1, is configured to be positioned at a position L when the handle 500 retracts to the pocket 92A of the duplex unit 92. The position L is equivalent to the retracted position or the storage position of the handle 500.

When the front end of the handle 500 is pulled outside the duplex unit 92 from its retracted position (storage position), that is, from the position L, so that the operator can hold the handle 500, the front end of the handle 500 is configured to be positioned at a position L1. A detailed description of the positioning mechanism is provided later.

As illustrated in FIG. 3, when the front end of the handle 500 in the advancing direction thereof retracts to or is stored in the pocket 92A of the duplex unit 92, that is, when the front end of the handle 500 is at position L, the rear end of the handle in the advancing direction thereof is positioned at L'.

By contrast, in a case in which the front end of the handle 500 retracts completely inside the image forming apparatus main body housing, that is, when the front end of the handle 500 is at a position L2, the rear end of the handle 500 is positioned at L2'.

The above-described arrangement means that a space in the image forming apparatus main body housing occupied by the rear portion of the handle 500 can be reduced by an amount indicated by H in FIG. 3, when the front end of the handle retracts or is stored in the pocket 92A, compared with a case in which the front end of the handle 500 retracts further back to L2 in the main body housing.

According to the illustrative embodiment, when the front end of the handle 500 in the advancing direction thereof is positioned or stored in the pocket 92A of the duplex unit 92, the position of the rear end of the handle 500 can be shifted toward the advancing direction by a degree to which the front end of the handle 500 moves in the pocket 92A, and thus the space in the main body housing occupied by the handle 500 can be reduced.

A reference character S in FIG. 3 indicates a length of the handle 500.

Figure 5:
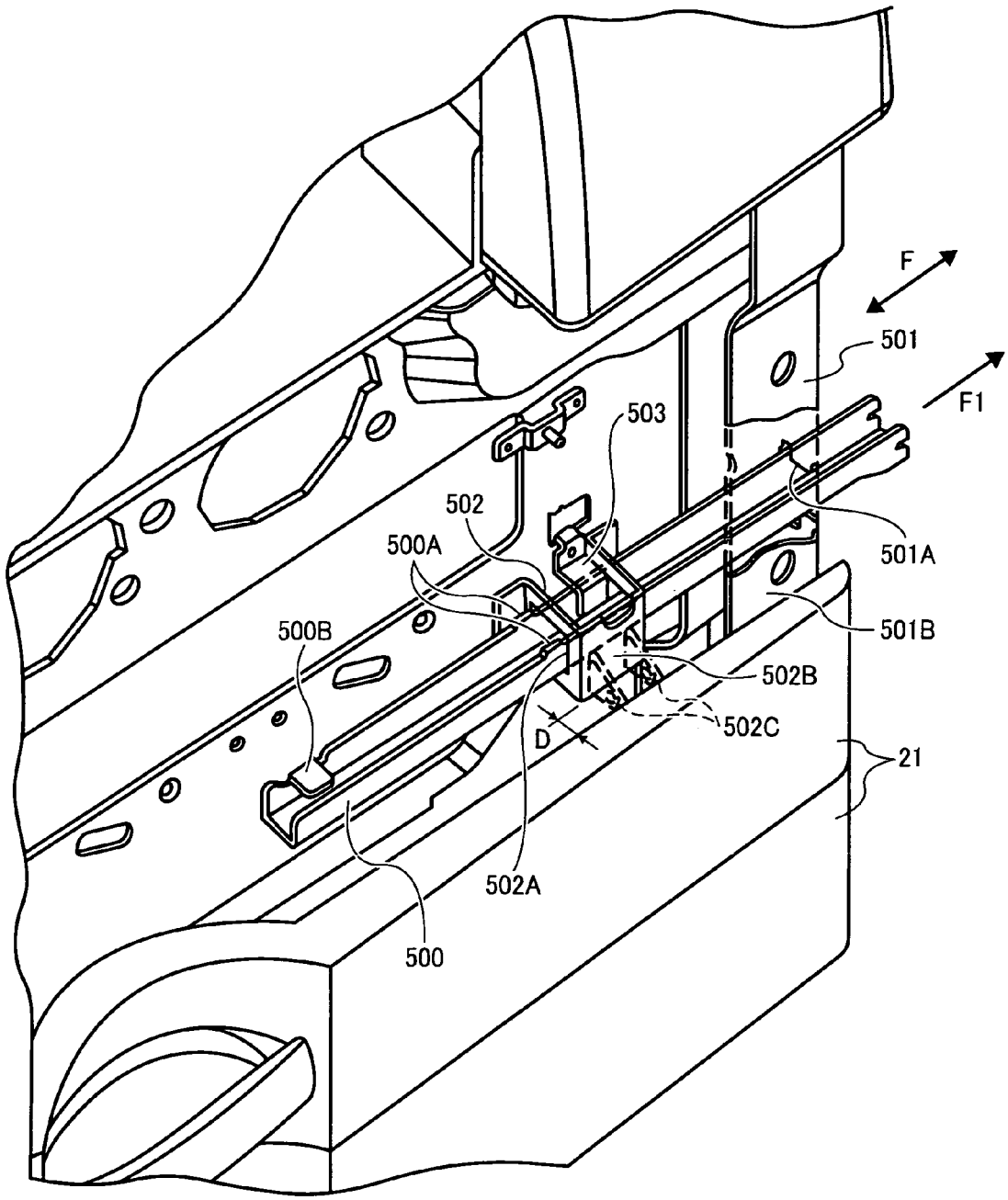
FIG. 5 is a schematic diagram illustrating an installation mechanism of the handle of FIG. 4 according to an illustrative embodiment of the present invention.

Referring now to FIG. 5, there is provided a schematic diagram illustrating a configuration for supporting the handle 500.

The handle 500 is inserted into insertion sections 501A and 502A provided to a first support frame 501 and a second support frame 502 disposed in the advancing direction of the handle 500, respectively, thereby guiding the handle 500 in the advancing direction indicated by arrow, F1 of FIG. 3.

In FIG. 5, the handle 500 is made of a sheet metal member having a channel-shaped or a substantially U-shaped cross section, the upper surface of which is opened. The first support frame 501 is a post member serving as a first support frame and provided at substantially the corner of the main body housing in the front side of the handle 500 in the advancing direction thereof indicated by arrow F1.

The second support frame 502 is provided inside the main body housing at substantially the rear side in the advancing direction of the handle 500.

The handle 500 is inserted into the insertion section 501A and 502A provided to the first support frame 501 and the second support frame 502, respectively.

It is to be noted that, when the handle 500 is formed of the channel-shaped plate member, a bottom surface thereof has a substantially large area. The bottom surface of the handle 500 contacts a palm of the hand of an operator and can reduce a load on the hand when the operator holds the handle 500. Further, when the handle 500 has a channel-shape, the weight of the handle 500 itself can be reduced while achieving the necessary sectional stiffness thereof.

However, the shape of the handle 500 is not limited to the foregoing structure. So long as the weight can be reduced and sectional stiffness is achieved, the cross-sectional shape of the handle 500 is not limited to the channel shape, but other cross-sectional shapes can be applied.

A portion in substantially near the front end of the handle 500 in the advancing direction thereof has a curved shape that projects downward and serves as a stopper for preventing the hand of the operator from slipping when the operator pulls out the handle 500.

The second support frame 502 serving as the second support frame is a bracket member that is channel-shaped or U-shaped. The base of the second support frame 502 is bent so as to be attached to the main body housing. The second support frame 502 includes first side surfaces facing each other and a front surface 502B serving as a second surface that bridges between the first side surfaces.

Each of the first side surfaces includes the insertion section 502A through which the handle 500 is inserted. It is to be noted that, for simplicity, the reference numeral 502A is provided to only one of the insertion sections of the second support frame 502 in FIG. 5.

In FIG. 5, the front surface 502B, serving as the second surface of the second support frame 502 disposed at substantially the rear side of the handle 500 in the advancing direction thereof, is located closer to the inside the main body housing than a front surface 501B of the first support frame 501, which is on the same plane of the front surface 502B.

In other words, the front surface 502B is disposed toward the main body housing by an amount indicated as D (hereinafter referred to as a gap D) than the surface of the first support frame 501 perpendicular to the advancing direction of the handle 500.

Accordingly, the front surface 502B of the second support frame 502 is retracted more toward the inside of the main body housing than the front surface 501B of the first support frame 501.

Figure 4:
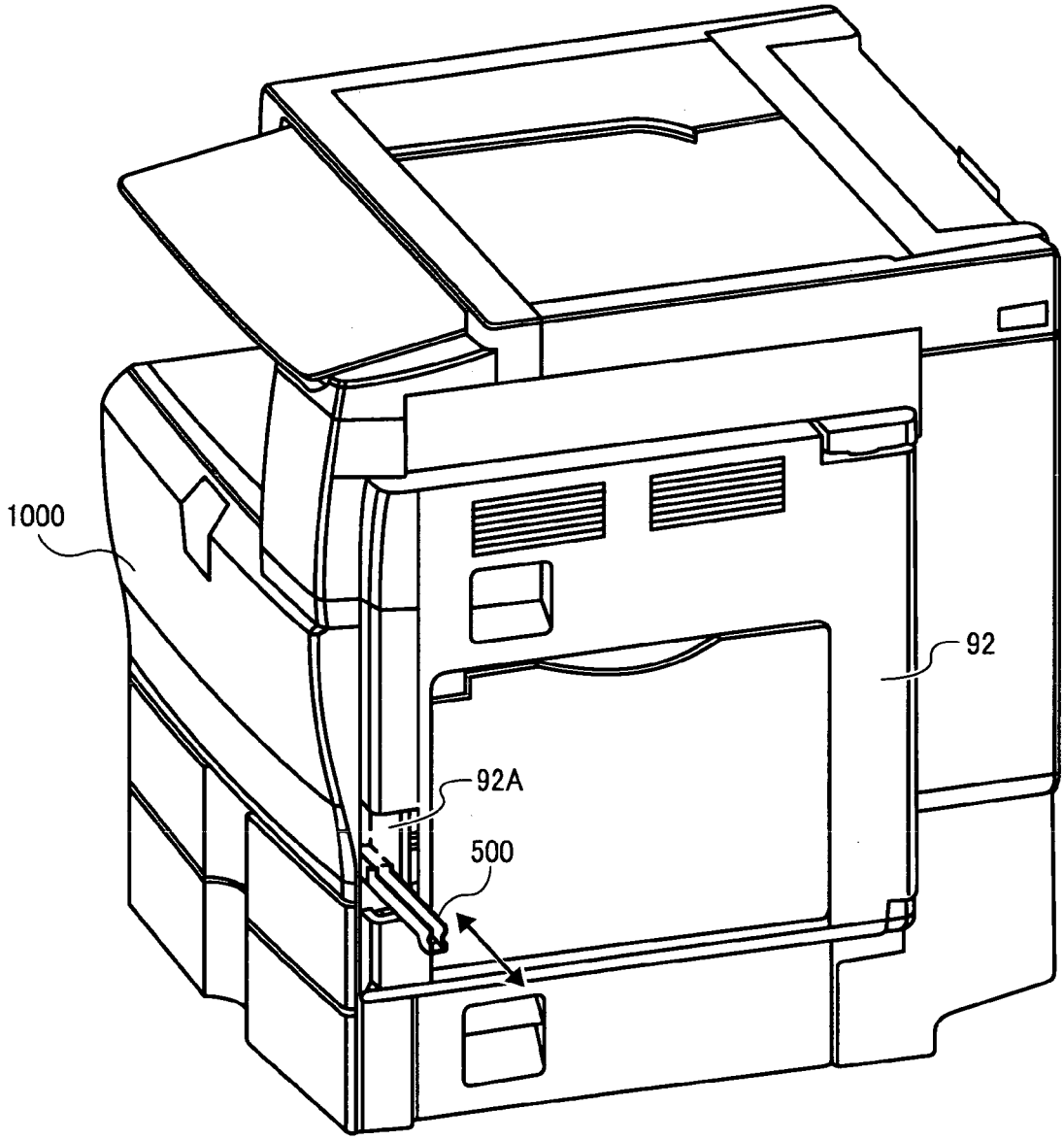
FIG. 4 is an external view of the image forming apparatus when a handle is pulled out from the image forming unit according to an illustrative embodiment of the present invention.

The front surface 502B of the second support frame 502 includes a hinge 502C serving as an attachment member which hingedly (rotatably) supports a front cover 1000, (illustrated in FIG. 4) that constitutes one of the side walls of the housing of the image forming apparatus main body 100. The hinge 502C is accommodated within the gap D.

Referring back to FIG. 4, the front cover 1000 serves as one of the exterior covers of the main body housing and is hingedly supported thereto by the hinge 502C. The front cover is openable about the hinge 502C so that the inside the main body housing can be exposed, thereby facilitating maintenance operation such as replacement of parts or components, for example, a later-described waste toner tank T (reference to FIG. 12).

By disposing the front surface 502B of the second support frame 502 closer to the main body housing than the front surface 501B of the first support frame 501, a hinged portion, not shown, of the front cover 1000 attached to the hinge 502C can be provided within the gap D, thereby reducing a space in the front and the back of the image forming apparatus main body 100, as compared to providing the hinge portion connecting to the front cover 1000 in front of the first support frame 501.

Accordingly, the second support frame 502 serves as the support member for the handle 500 while serving as an attachment member that connects the exterior cover. With this configuration, the second support frame 502 becomes a single component serving multiple functions.

With reference to FIG. 5, on the upper surface of the handle 500, protrusions 500A projecting upward and a flap 500B extending in a horizontal direction are provided along the advancing direction of the handle 500.

Each of the protrusions 500A is provided at substantially the front of the handle 500 in the advancing direction thereof and is provided to each side of the channel. The flap 500B is provided at substantially the rear side of the handle 500 and extends horizontally over the channel of the handle 500.

Figure 6A:
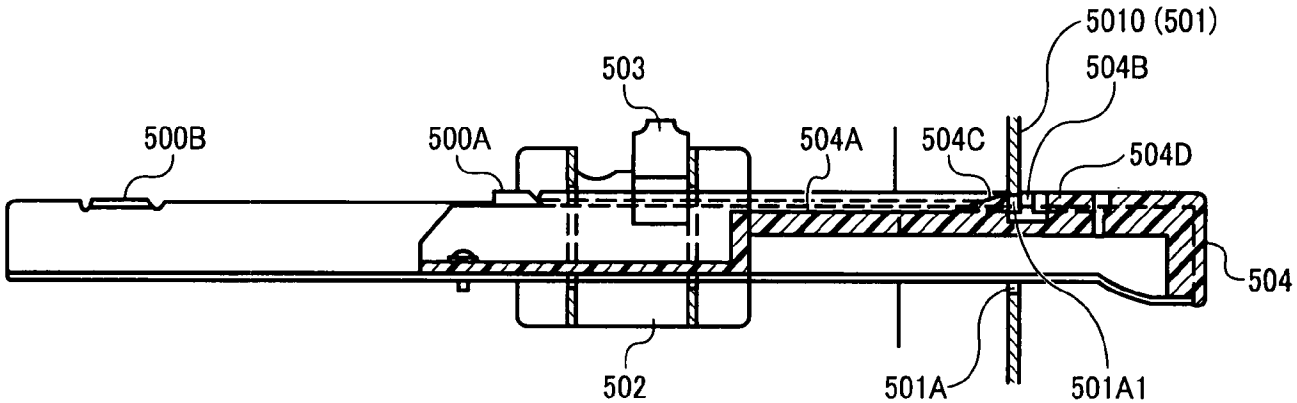
FIG. 6A is a side view illustrating a handle positioning mechanism when the handle is at a retracted position according to an illustrative embodiment of the present invention.
Figure 6B:
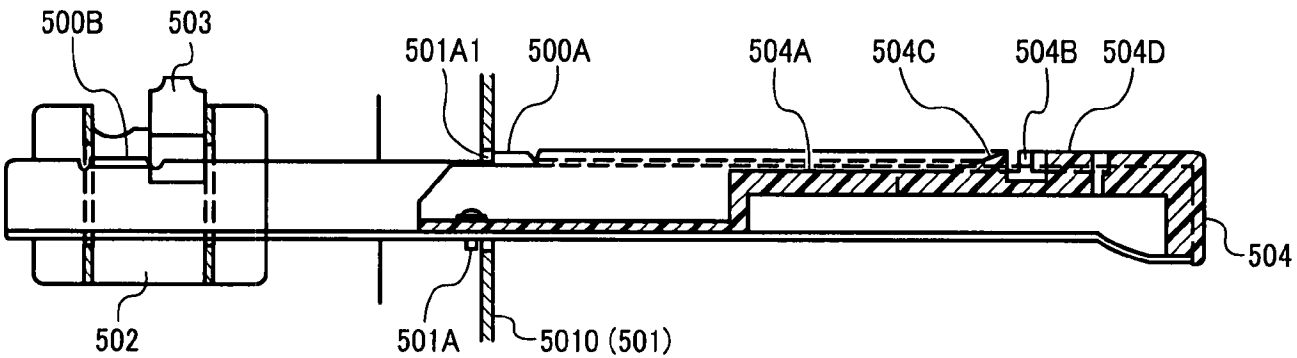
FIG. 6B is a side view illustrating the handle positioning mechanism when the handle is at an advanced position according to an illustrative embodiment of the present invention.

The protrusions 500A are substantially oblong-shaped along the advancing direction of the handle 500. As illustrated in FIG. 6B, when the handle 500 is pulled out to its advanced position, the protrusions 500A come to a position outside the insertion section 501A of the first supporting frame 501, and the rear end surface of the handle 500 faces the vicinity of the insertion section 501A.

Accordingly, when the handle 500 is raised, the protrusions 500A contact the surface in the vicinity of the insertion section 501A so as to lock the handle 500 by the first support frame 501, thereby distributing the weight load acting on the handle 500 to the first support frame 501.

As illustrated in FIG. 6B, the front surface of the flap 500B in the advancing direction, that is, a direction toward the right in FIG. 6B, comes into contact with and is locked by a lock member 503 provided across from the front surface 502B between the base of the second support frame 502, thereby preventing the handle 500 from advancing beyond a predetermined amount.

The flap 500B serves as a stopper that is locked relative to the second support frame 502 so as to position the handle 500 properly when the handle 500 is pulled out to its advanced position.

Figure 7:
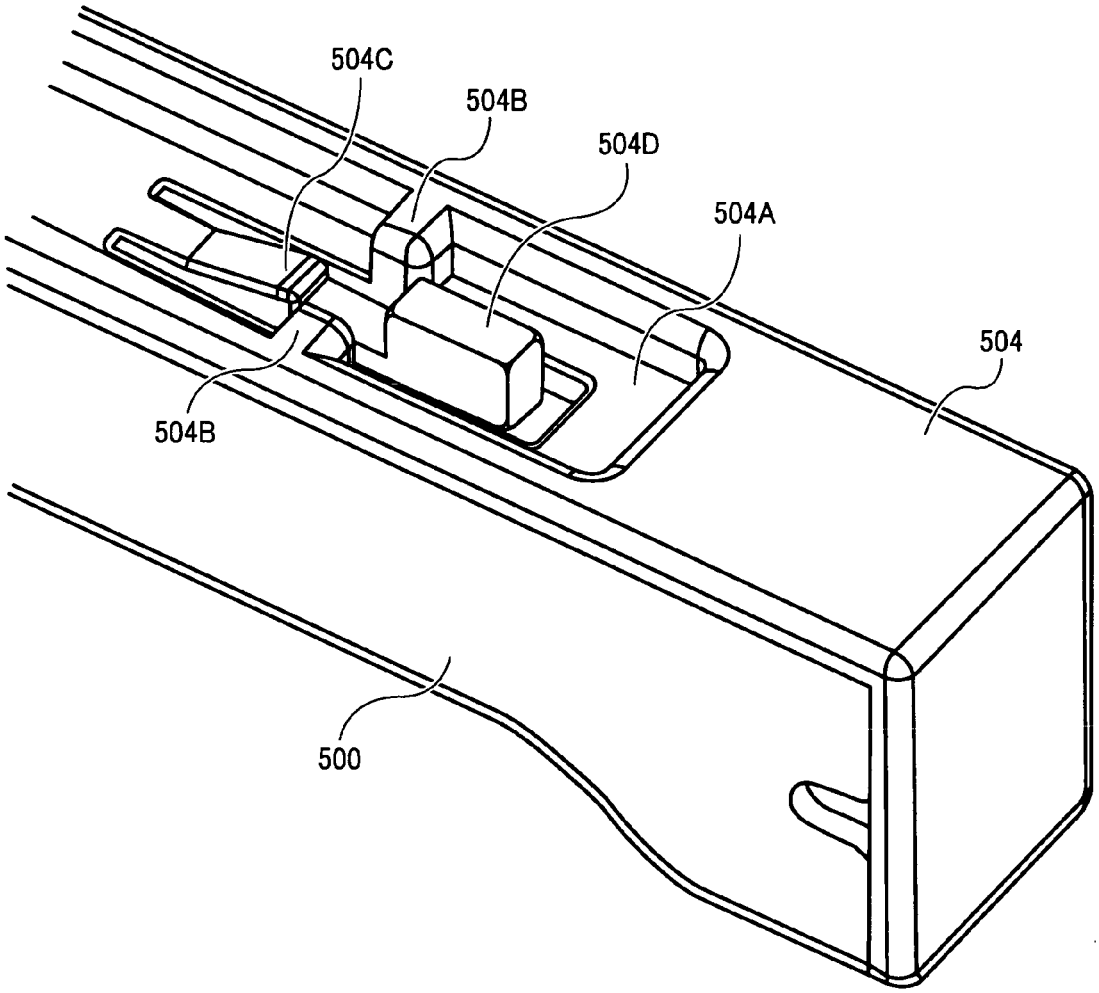
FIG. 7 is a schematic diagram illustrating the handle with a cover member with a stop mechanism according to an illustrative embodiment of the present invention.

By contrast, FIG. 7 illustrates a configuration of a lock mechanism of the handle 500 when the handle 500 is in the retracted position.

Referring now to FIG. 7, there is provided a schematic diagram illustrating a portion of the handle 500 including a cover 504 serving as a stopper when the handle 500 is in the retracted position.

As illustrated in FIG. 7, the cover 504 serving as a stopper to position the handle 500 at the retracted position is provided such that the cover 504 covers the upper surface of the handle 500.

The cover 504 is a molded member made of flexible resin. When the cover 504 covers the upper surface of the handle 500, the area of the handle 500 held by the operator increases so that concentration of load or strain exerted on the hand of the operator as the operator holds the handle 500 can be reduced.

The upper surface of the cover 504 includes a recess portion 504A in the vicinity of the front end of the handle 500. Inside the recess portion 504A, a lock system 504B and a flap 504C are provided.

The lock system 504B is provided such that, as illustrated in FIG. 10, when the handle 500 is at the retracted position, the lock member 504B is configured to project above the upper surface 501A1 of the insertion section 501A of the first support frame 501.

The lock system 504B is integrally formed with the opposing surfaces of the recess portion 504A in the width direction thereof, that is, in a direction perpendicular to the advancing/retracting direction of the handle 500.

The flap 504C is swingably provided substantially behind the lock system in the advancing direction thereof such that the flap 504C can be positioned above the surface 501A1 of the first support frame 501 so as to sandwich the first support frame 501 between the flap 504C and the lock system 504B. Further, the flap 504C can be inserted into the insertion section 501A.

In particular, the flap 504C is disposed so as to contact one surface of the first support frame 501 in the thickness direction of the first support frame 501 at an opposite side of the lock system 504B, thereby sandwiching the first support frame 501 with the lock system 504B.

The flap 504C is formed such that a portion of the recess portion 504A is cut out into a bridge-like shape cantilevered at one end. Normally, the flap 504C is positioned overlappingly higher than the insertion section 501A substantially above the upper surface of the insertion section 501A of the first support frame 501. When a later-described pressing member 504D is pressed, the flap 504C is released from the overlapping state and enable to move in the insertion section 501A.

The pressing member 504D is integrally provided with the one free end of the flap 504C that is not cantilevered, and configured to depress the flap 504C positioned substantially above the upper surface of the insertion section 501A so that the flap 504C can move into the insertion section 501A when the pressing member 504D is depressed.

Figure 8:
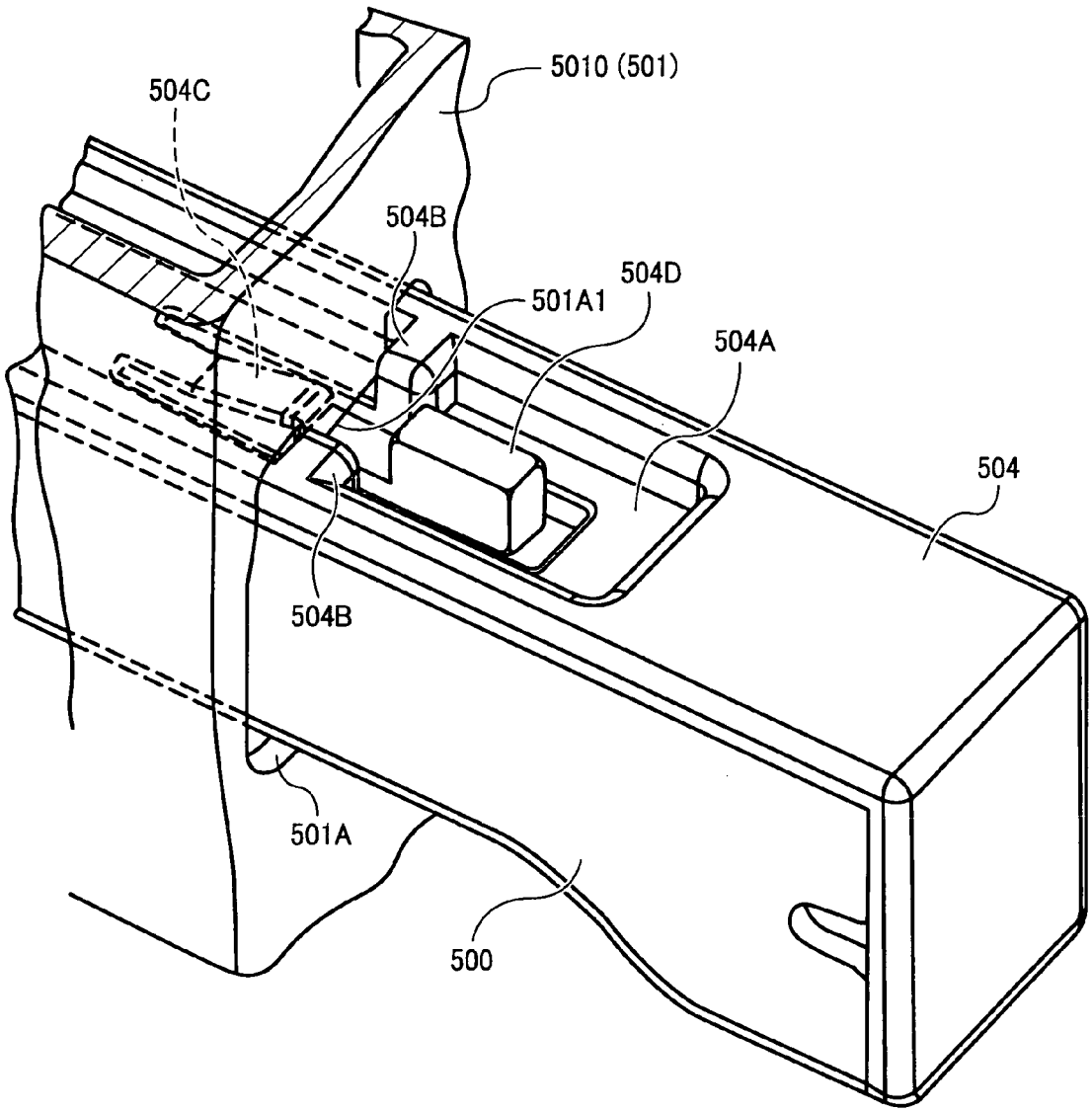
FIG. 8 is a schematic diagram conceptually illustrating the stop mechanism of FIG. 7 and a first support frame according to an illustrative embodiment of the present invention.

When the pressing member is no longer pressed, as illustrated in FIG. 8, the flap 504C returns to its original position due to resilience, that is, to a position overlapping the portion of the insertion section 501A.

Referring now to FIG. 8, there is provided a schematic diagram illustrating a state in which the pressing member 504D is not depressed. When the pressing member 504D is not pressed, the lock system 504B and the flap 504C are substantially higher than the upper surface of the insertion section 501A and sandwich the first support frame 501 therebetween.

By contrast, when the pressing member 504D is pressed, the flap 504C is depressed in the recess portion 504A, thereby enabling the flap 504C to be inserted in the insertion section 501A. As a result, the lock system 504B and the flap 504C no longer sandwich the first support frame 501 and the handle 500 can be pulled out from the retracted position.

As described above, the cover 504 serving as a stopper for the handle 500 positions the handle 500 at its retracted position or the storage position and also allows the handle 500 to move from the retracted position to the advanced position.

A description will be now provided of a configuration for facilitating the movement of the handle 500 and prevention of damage when the handle 500 is raised.

The insertion section 501A of the first support frame 501 is either sandwiched by the lock system 504B and the flap 504C of the cover member 504 or free from the lock system 504B and the flap 504C, thus allowing the handle 500 to move. In addition, the insertion section 501A of the first support frame 501 is configured to facilitate the movement of the handle 500 and prevent damage when the handle 500 is raised.

Figure 9:
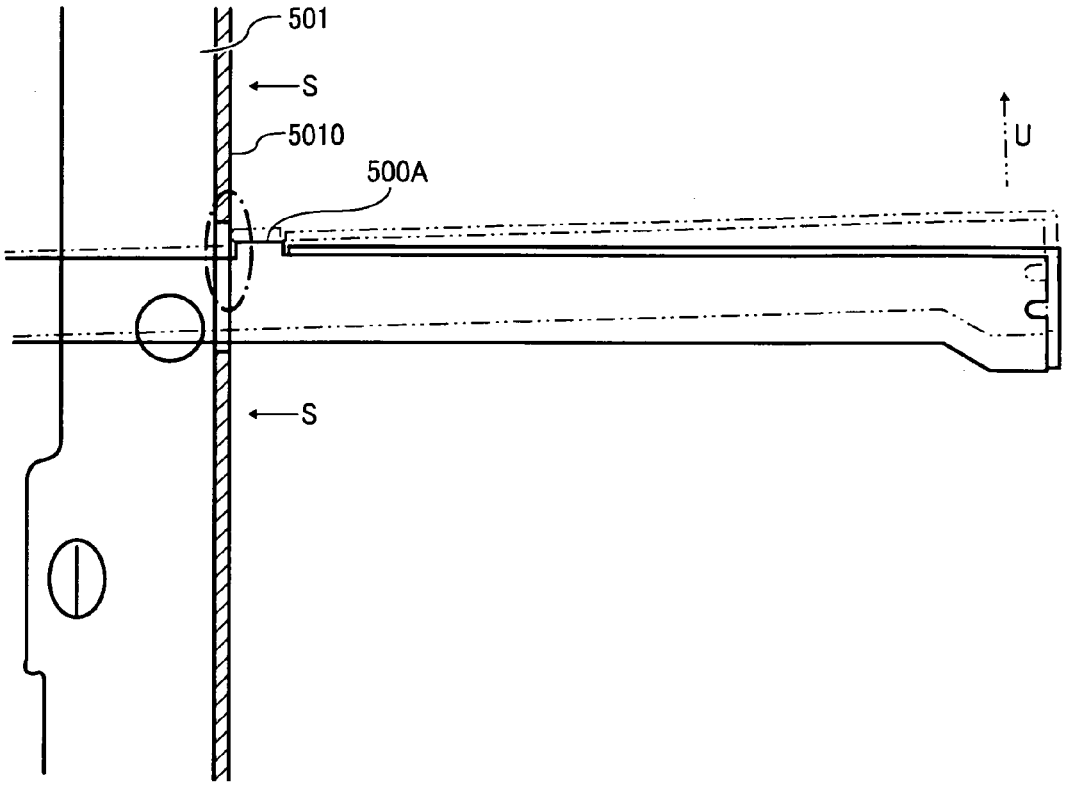
FIG. 9 is a side view conceptually illustrating an insertion portion of the first support frame of FIG. 8 according to an illustrative embodiment of the present invention.

Referring now to FIG. 9, there is provided a schematic diagram illustrating the handle 500 when the handle 500 is pulled out to the advanced position (indicated by a solid line) and when the handle 500 is raised in a direction of arrow U upon transport of the image forming apparatus (indicated by a dotted line).

As illustrated in FIG. 9, when the handle 500 is pulled out, the handle 500 moves in substantially the horizontal direction. By contrast, as indicated by the double-dotted line, when the handle 500 is raised, due to the tilt of the handle 500, the rear surface of each of the protrusions 500A in the advancing direction, provided on the upper surface of each side surface of the channel of the handle 500, is configured to contact a surface 5010 of the first support frame 501.

Accordingly, when the handle 500 is raised, the rear surface of the protrusions 500A in the longitudinal direction thereof contacts the surface 5010 of the first support frame 501, thereby enhancing the sectional stiffness of the handle 500 against shear force applied when contacting the surface 5010, as compared to the case in which shear force is applied to the surfaces in the short side directions contacting the surface 5010.

Figure 10A:
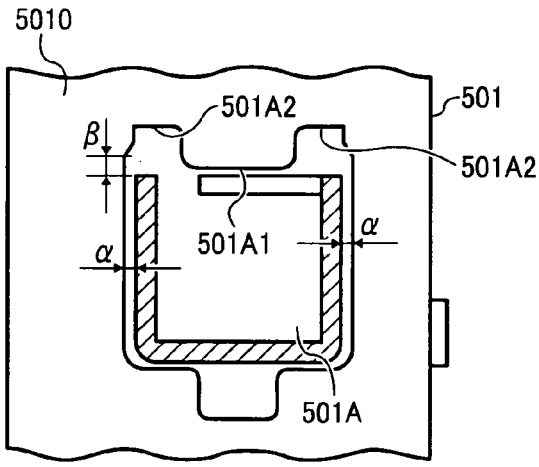
FIG. 10A is a cross-sectional view illustrating the handle and the first support frame as viewed from a direction of arrow S of FIG. 9, when the handle is at the retracted position according to an illustrative embodiment of the present invention.
Figure 10B:
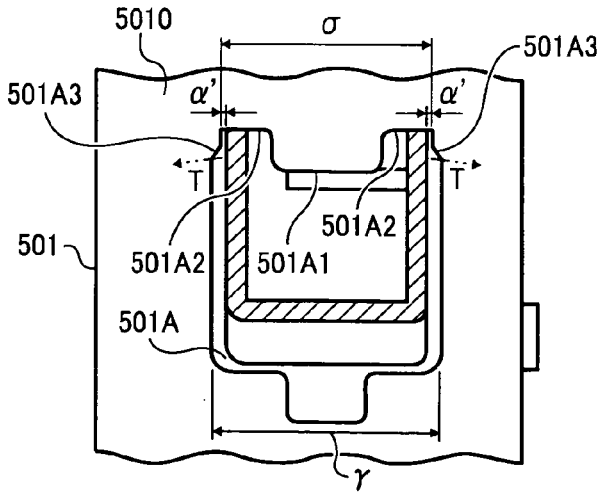
FIG. 10B is a cross-sectional view illustrating the handle and the first support frame as viewed from the direction of arrow S of FIG. 9, when the handle is raised according to an illustrative embodiment of the present invention.

Referring now to FIGS. 10A and 10B, cross-sectional views of the handle 500 as viewed from a direction of arrow S in FIG. 9 are provided. FIG. 10A illustrates the handle 500 when it is pulled out. In other words, FIG. 10 illustrates the handle 500 when it is in a state shown by the solid line in FIG. 9.

By contrast, FIG. 10B illustrates the handle 500 when raised in the direction of arrow U of FIG. 9. In other words, the handle is in a state shown by the double dotted line in FIG. 9.

As illustrated in FIG. 10A, when the duplex unit 92 is closed, gaps $\alpha$ and $\beta$ are formed in the insertion section 501A of the first support frame 501 between the handle 500 that moves in the insertion section 501A and each of the surfaces including top, bottom, the left and the right surfaces of the insertion section 501A, except for a place where the flap 504C of the cover 504 serving as the stopper contacts the surface 501A1 as viewed from the advancing and retracting direction of the handle 500.

In other words, the upper surface of the insertion section 501A, except the surface 501A1 that is sandwiched by the flap 504C and the lock system 504B, includes recess portions 501A2 that are upwardly recessed at both sides of the 501A.

As illustrated in FIG. 10B, when the handle 500 is raised, the side walls of the handle 500 fit into the recess portions 501A2. Slanted surfaces 501A3 extend from each of the recess portions 501A2 to the side surfaces facing the handle 500.

The slanted surfaces 501A3 are formed such that an external width a of the recess portions 501A2 is configured to be less than an inner width $\gamma$ opposite the bottom surface of the handle 500. In other words, the slanted surfaces 501A3 are inclined such that the left and the right inner surfaces of the insertion section 501A facing the left and the right surfaces of the handle 500 approach the upper surface of the recess portions 501A2.

Further, the recess portions 501A are formed such that, preferably, gaps $\alpha'$ between the recess portions 501A2 and each of the side walls of the handle 500 are as small as possible.

Such a-configuration facilitates guiding of the side walls of the handle 500 into the recess portions 501A2 along the slant surfaces A3 when the handle 500 is raised.

Since the gaps $\alpha'$ are configured to be significantly small, or there is hardly a gap between the recess portions 501A2 and the side walls of the handle 500, the handle 500 is prevented from being deformed in directions indicated by arrows T or the left and the right directions as viewed from the advancing/retracting directions of the handle 500 when the handle 500 is raised.

Figure 11:
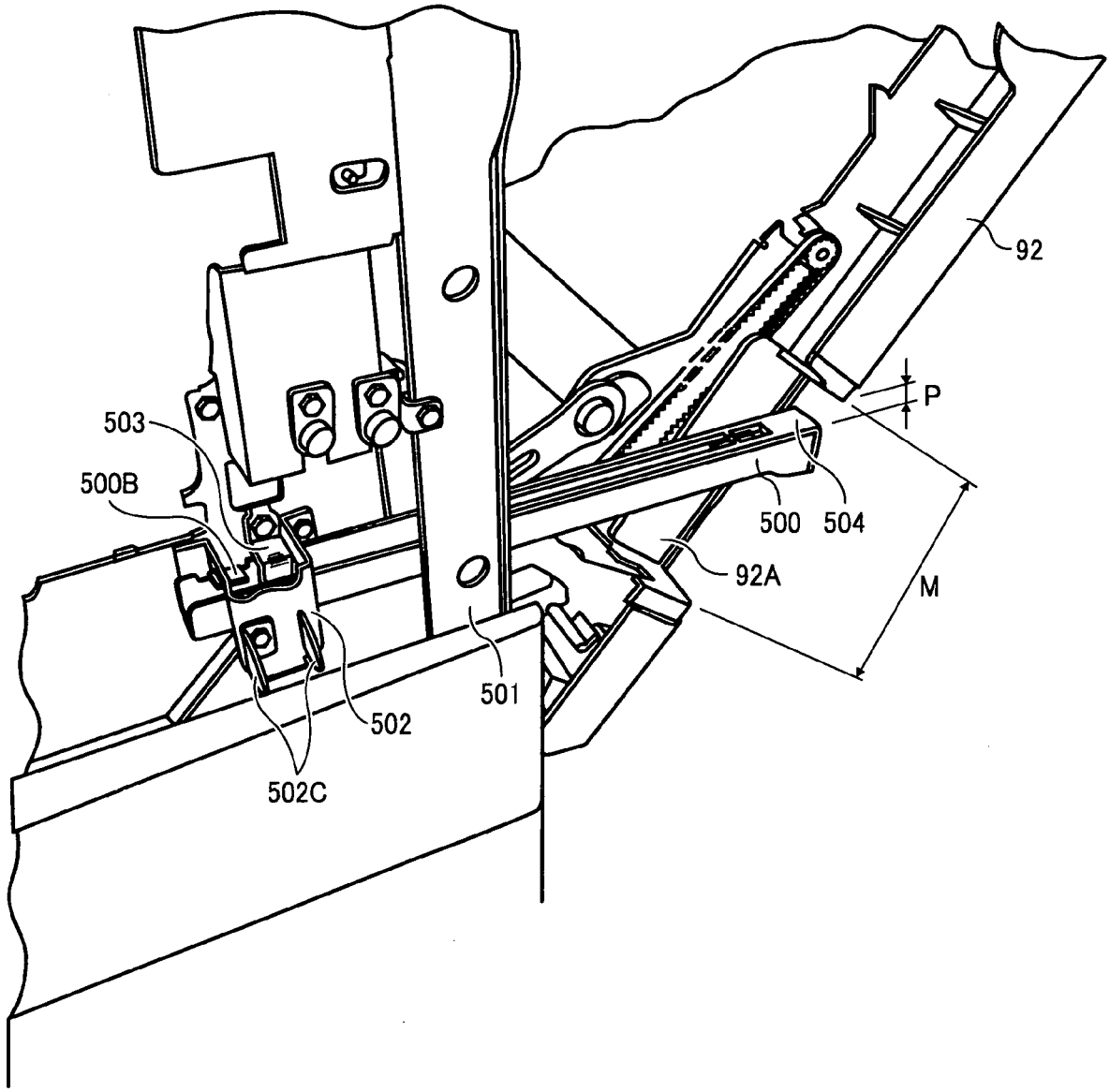
FIG. 11 is a perspective view illustrating a duplex unit of the image forming apparatus and the handle when the duplex unit is opened according to an illustrative embodiment of the present invention.

Referring now to FIG. 11, there is provided a partial external view illustrating the duplex unit 92 when the duplex unit 92 is opened. As described above, the duplex unit 92 is openable in the direction perpendicular to the advancing direction of the handle 500.

When the handle 500 is pulled out and the duplex unit 92 is opened, as illustrated in FIG. 11, the pocket 92A has a height M in the vertical direction thereof so that a space P is formed to prevent the handle 500 from being held by the operator.

In other words, when the handle 500 is pulled out and the duplex unit 92 is opened, the space P that is not large enough for the operator to hold is formed between the upper surface of the handle 500 and the pocket 92A, thereby preventing the operator from holding the handle 500.

According to this configuration, even if the duplex unit 92 is opened, the operator cannot hold and lift the handle 500 that is configured to be pulled out and lifted assuming that the duplex unit 92 is closed. Accordingly, significant load placed on the handle 500 due to fluctuation of the weight balance can be prevented, thereby preventing damage to the handle 500.

Figure 12:
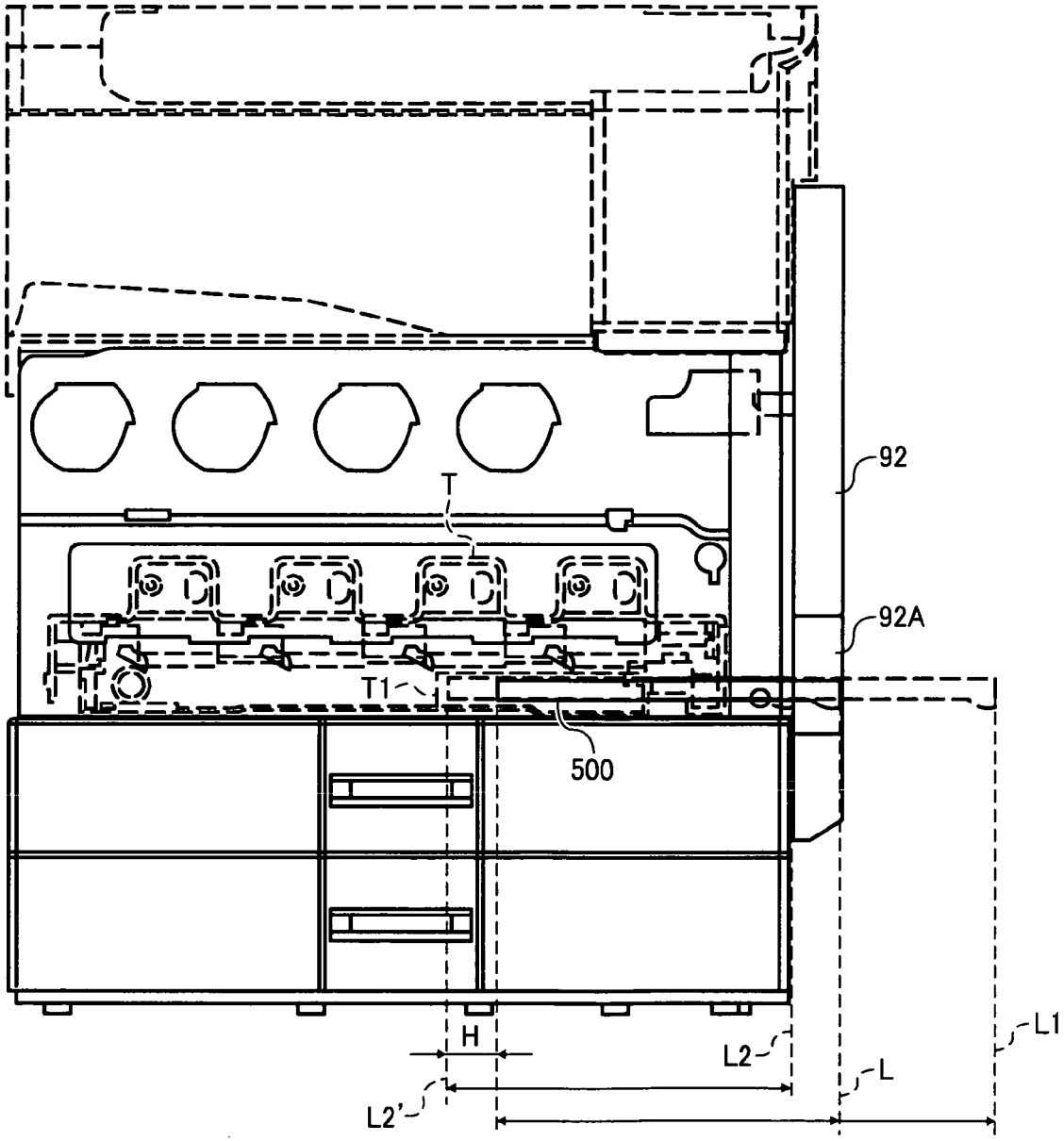
FIG. 12 is a schematic diagram conceptually illustrating a toner tank including a clearance for the handle according to an illustrative embodiment of the present invention.

Referring now to FIG. 12, there is provided a schematic diagram illustrating a waste toner tank T including a handle storage portion T1 configured to accommodate a portion of the handle 500.

Although the handle 500 occupies a small space in the image forming apparatus main body 100, there may be a case in which some components are already disposed where a portion of the handle 500 is disposed.

An example of such a case is that the waste toner tank T serving as a storage member for waste toner is provided in the image forming apparatus as a preinstalled component, and the waste toner tank T is exposed as the front cover 1000 is opened.

The toner tank T is configured to store and secure a certain amount of the waste toner. According to the illustrative embodiment, as illustrated in FIG. 13A, the waste toner tank T includes the handle storage portion T1 configured to accommodate the handle 500.

Figure 13A:
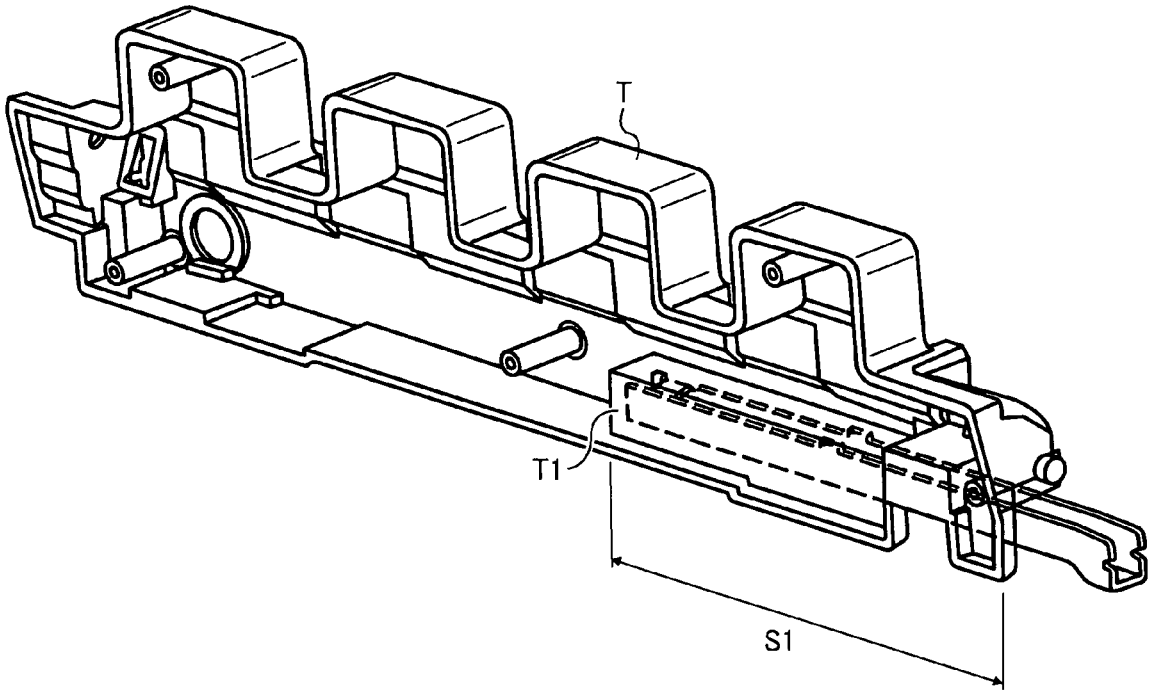
FIG. 13A is a schematic diagram illustrating inside the toner tank of FIG. 12 according to an illustrative embodiment of the present invention.
Figure 13B:
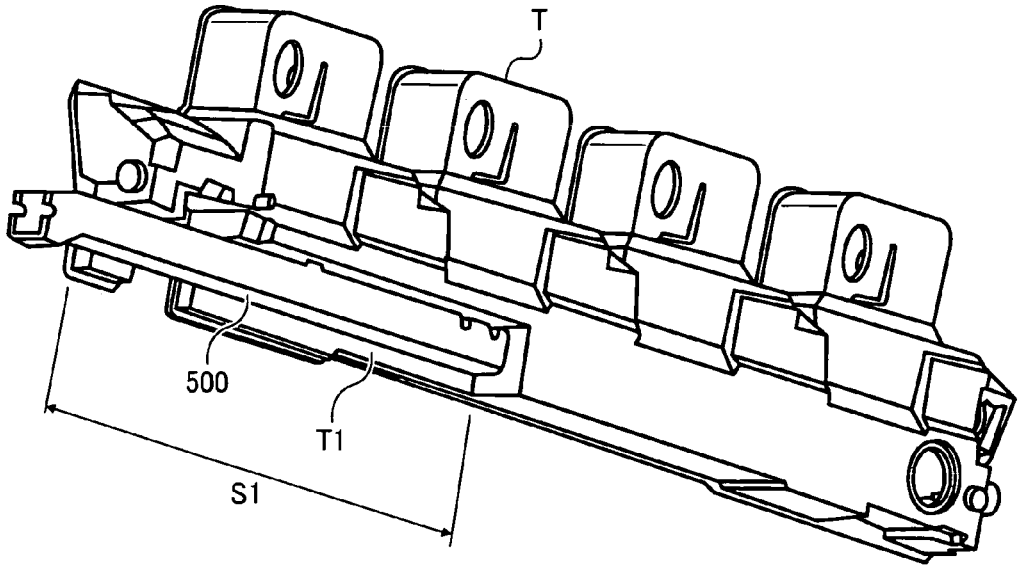
FIG. 13B is a schematic diagram illustrating the back of the toner tank according to an illustrative embodiment of the present invention.

It is to be noted that FIG. 13A illustrates the inside of the waste toner tank T, whereas FIG. 13B illustrates the waste toner tank T as viewed from the rear side thereof.

As illustrated in FIG. 13B, the handle storage portion T1 of the waste toner tank T is a pocket, that is, a recessed portion provided at a position where the handle 500 is retracted into the waste toner tank T.

The handle storage portion T1 of the waste toner tank T allows the waste toner tank T to accommodate the handle 500 indicated by S1 in FIG. 13, that is, the portion of the handle 500 when the front end of the handle 500 in the advancing direction thereof is at the position L.

According to this configuration, the handle 500 can be provided in the toner tank T, thereby eliminating the need for an additional installation space for the handle 500.

Further, as compared to the waste toner tank T provided at a different position from that of the handle 500 so as not to interfere with the installation position of the handle 500, the installation position of the handle 500 can be secured without changing the installation position of the preinstalled waste toner tank T when the handle 500 is stored.

Still further, in a case in which the handle 500 is stored in the waste toner tank T as described above, since the space occupied by the handle 500 is relatively small in the waste toner tank T, undesirable reduction of space dedicated for storing the toner waste can be prevented.

Figure 14:
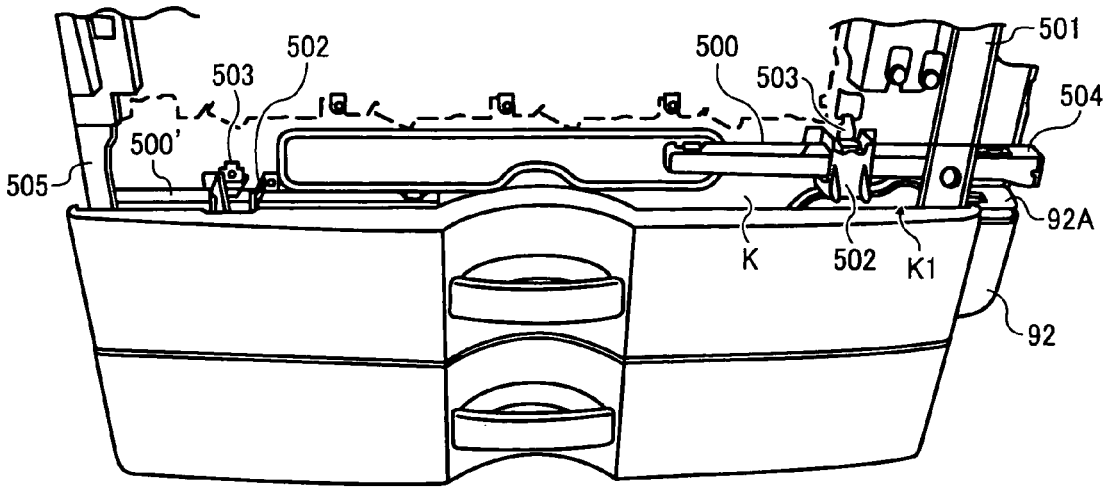
FIG. 14 is a schematic diagram illustrating a sheet cassette of the image forming apparatus and the handle according to an illustrative embodiment of the present invention.
Figure 15:
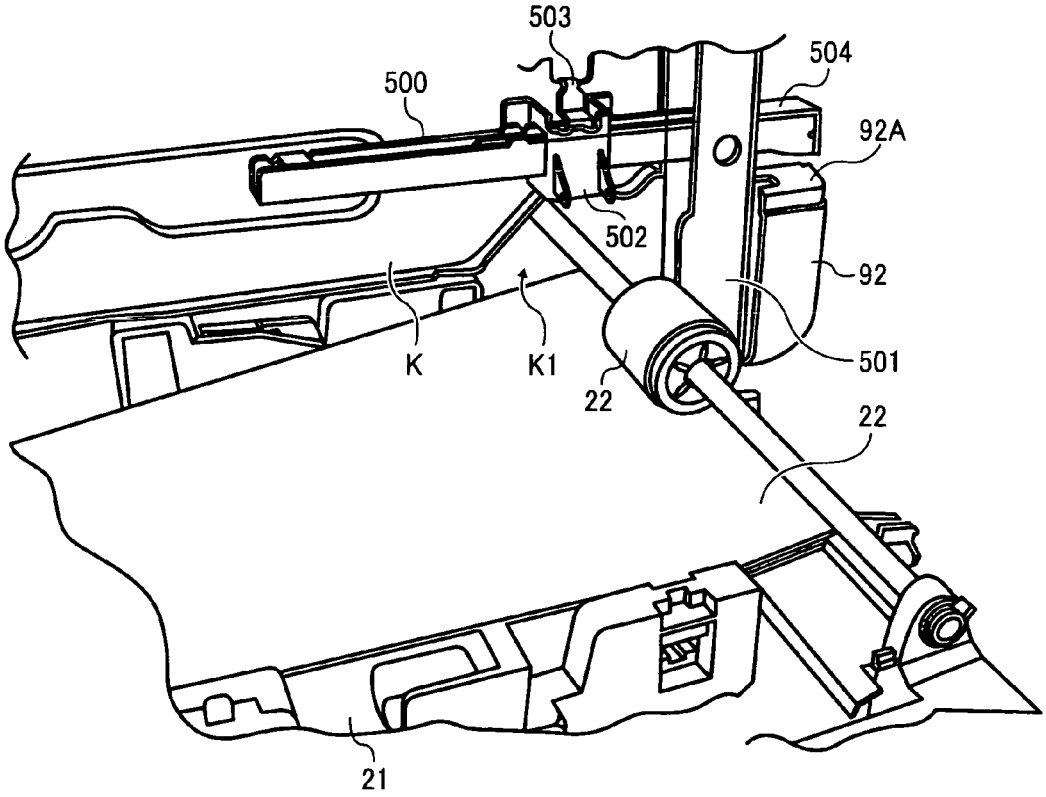
FIG. 15 is a schematic diagram illustrating a positional relation of a sheet feed roller of the sheet cassette of FIG. 14 and the handle according to an illustrative embodiment of the present invention.

Referring now to FIG. 14 and FIG. 15, there are provided schematic diagrams illustrating another example of a case in which a preinstalled component, for example, the sheet cassette, is disposed at a position where the handle 500 is stored in the main body housing.

Although only the front portion of the image forming apparatus main body 100 is illustrated in FIG. 14 and FIG. 15, the handle 500 is provided at four corners of the image forming apparatus main body housing so that the weight of the image forming apparatus is equally distributed during transport of the image forming apparatus.

In particular, the handle 500 is provided in the vicinity of the first support frame 501 serving as a post member of the front side of the image forming apparatus from which the sheet cassette 21 is pulled out.

A second handle 500' is provided in the vicinity of a frame 505 serving as a post member of the other end of front side across from the first support frame 501.

It is to be noted that, as illustrated in FIG. 1, the second handle 500' can be pulled out and retracted to an insertion section 92B that is provided on the other side of the main body housing where the first support frame 501 is provided.

As illustrated in FIG. 15, the sheet cassette 21 that can be pulled out from the main body housing of the image forming apparatus main body includes the sheet feed roller 20 that picks up and sends the paper sheet 22 from the sheet cassette 21. The sheet feed roller 20 is disposed substantially above the sheet stack surface of the sheet feed cassette 21.

It is to be noted that a reference character K in FIG. 15 refers to the main body housing. A clearance or pocket K1 for the sheet feed roller 20 is provided to the main body housing K such that when the sheet cassette 21 is retracted into the main body housing K, the sheet feed roller 20 does not interfere with the sheet cassette 21.

According to the illustrative embodiment, the handle 500 provided in the vicinity of the sheet feed roller 20 is disposed at a different position in the height direction relative to the second handle 500' disposed at substantially the other end of the front side where there is no sheet feed roller 20. In particular, in order to prevent the handle 500 from interfering with the sheet feed roller 20, the handle 500 is disposed substantially higher than the sheet feed roller 20.

Accordingly, the sheet feed roller 20 that moves in association with the sheet cassette 21 as the sheet cassette 21 is pulled out does not interfere with the handle 500, thereby facilitating installation of the sheet cassette 21.

Further, when the handle 500 occupies relatively little space substantially above the sheet cassette 21, the size of the clearance K1 in the main body housing K can be reduced in both the height direction of the main body housing K as well as the advancing and retracting directions of the handle 500.

In addition, when the size of the clearance K1 is reduced, the stiffness of the main body housing that supports the main components associated with the image forming operations in the image forming apparatus main body can be enhanced or improved.

Figure 16:
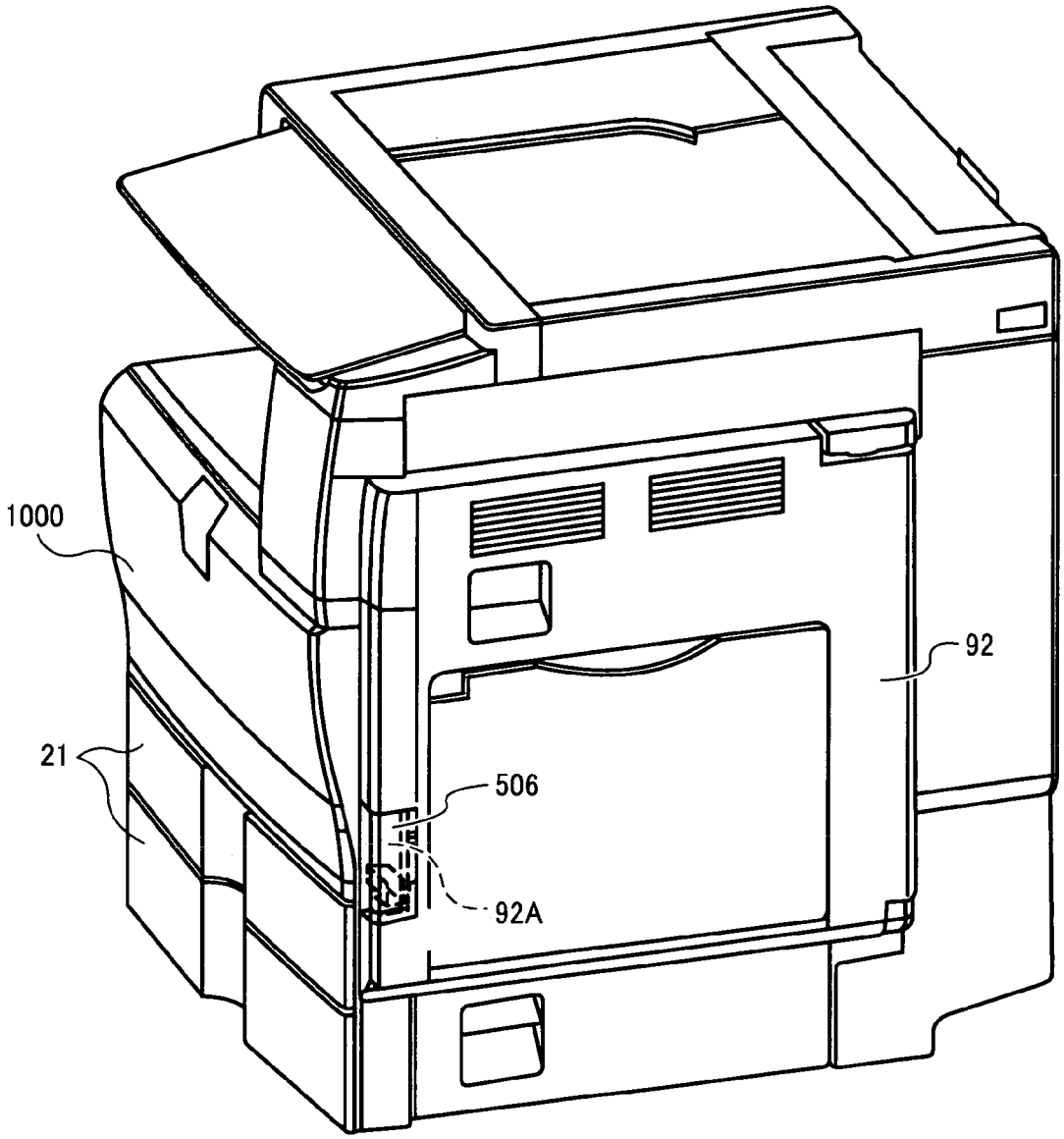
FIG. 16 is a schematic diagram illustrating a pocket provided to the duplex unit and a cover member provided thereto according to an illustrative embodiment of the present invention.

Referring now to FIG. 16, there is provided an external view of the image forming apparatus main body 100 when the handle 500 is retracted/stored in the main body housing of the image forming apparatus.

In FIG. 16, a cover 506 is provided to the pocket 92A of the duplex unit 92 so as to cover the pocket 92A when the handle 500 is at the retracted position.

The cover 506 is openably and closably provided to the duplex unit 92. When the duplex unit 92 is closed, the cover 506 covers the pocket 92A so as to constitute a part of the exterior surface of the duplex unit 92.

When the handle 500 is pulled out from the retracted position to the advanced position, the cover 92A is opened, exposing the front end of the handle 500 in the advancing direction thereof.

With this configuration, it is possible to prevent the handle 500 from being pulled out unintentionally. Further, when the cover 506 is provided to cover the pocket 92A, the exterior appearance of the image forming apparatus main body remains unchanged regardless of the presence of the pocket 92A.

It is to be noted that elements and/or features of different illustrative embodiments may be combined with each other and/or substituted for each other within the scope of this disclosure and appended claims.

The number of constituent elements, locations, shapes and so forth of the constituent elements are not limited to any of the structure for performing the methodology illustrated in the drawings.

Still further, any one of the above-described and other illustrative features of the present invention may be embodied in the form of an apparatus, method, or system.

For example, any of the aforementioned methods may be embodied in the form of a system or device, including, but not limited to, any of the structure for performing the methodology illustrated in the drawings.

Illustrative embodiments being thus described, it will be obvious that the same may be varied in many ways. Such illustrative variations are not to be regarded as a departure from the spirit and scope of the present invention, and all such modifications as would be obvious to one skilled in the art are intended to be included within the scope of the following claims.

What is claimed is:

1. An image forming apparatus for forming an image, comprising:

an image bearing member configured to bear a latent image on a surface thereof;

a charging unit configured to charge the image bearing member;

a developing unit configured to supply toner to the latent image so as to develop the latent image;

a transfer unit configured to transfer the toner image onto a transfer medium;

a main body housing including a plurality of walls;

a duplex unit openably and closably provided to one of the plurality of walls of the main body housing, configured to turn over a recording medium; and a handle disposed within a wall of the main body housing including the duplex unit configured to advance from and retract to the wall of the main body housing including the duplex unit, wherein the duplex unit includes a pocket comprising a clearance formed in an advancing/retracting direction of the handle and a direction perpendicular to and adjoining the advancing/retracting direction of the handle so as to expose the handle inside the duplex unit, and wherein a front end of the handle in the advancing direction thereof is configured to be positioned at a retracted position when the front end of the handle is retracted to the pocket, and positioned at an advanced position outside the duplex unit when the handle is pulled out from the retracted position.

2. The image forming apparatus according to claim 1, further comprising:

a support frame provided to an inner surface of the wall of the main body housing, the support frame including an insertion section through which the handle is inserted, wherein the handle includes a stopper configured to lock the handle to the support frame at either the retracted position or the advanced position.

3. The image forming apparatus according to claim 2, further comprising a plurality of the support frames provided along the advancing/retracting direction of the handle, wherein a support frame is provided in the main body housing at substantially the rear side of the handle in the advancing direction thereof, different from the support frame provided to the inner surface of the wall, the support frame including first surfaces perpendicular to the advancing/retracting direction of the handle and facing each other including the insertion section, and a second surface that bridges the first surfaces and is disposed closer to an inside the main body housing in the direction perpendicular to the advancing direction of the handle than the side surface of the other support frame including the insertion section, the second surface including an attachment member that hingedly supports an exterior cover constituting one of the walls of the main body housing so that the exterior cover is openable.

4. The image forming apparatus according to claim 2, wherein, when the duplex unit is closed, a gap is formed between the handle and each of the left, right, top and bottom surfaces of the insertion section of the support frame so as to prevent contact between the handle and each of the left, right, top and bottom surfaces of the insertion section of the support frame except for the portion of the insertion section that engages the stopper in the advancing/retracting direction of the handle.

5. The image forming apparatus according to claim 2, wherein the stopper comprises a cover member formed of flexible material and provided to the upper surface of the handle, a lock member that is provided to the upper surface of the cover member and projects substantially higher than the insertion section, and a flap that is swingably provided substantially behind the lock member in the advancing direction of the handle and movable inside the insertion section and to a substantially higher position than the insertion section, and wherein the handle is either locked to or released from the retracted position by the lock member and the flap.

6. The image forming apparatus according to claim 1, wherein the handle has a channel-shape in cross-section, an upper side of which is opened.

7. The image forming apparatus according to claim 6, wherein the insertion section of the support frame includes a deformation prevention portion configured to prevent the handle from being deformed in the left and the right directions of the advancing/retracting direction of the handle when the handle is raised.

8. The image forming apparatus according to claim 7, wherein, in the deformation prevention portion, a gap between the left and the right surfaces of substantially the upper portion of the handle and the inner surfaces of the insertion section facing the left and the right surfaces of the upper portion of the handle is formed substantially smaller than a gap between the left and the right surfaces of substantially the bottom portion of the handle and the inner surfaces of the insertion section.

9. The image forming apparatus according to claim 1, wherein, when the duplex unit is opened and the handle is at the advanced position, a gap too small to allow the handle to be grasped is formed between the pocket and the upper surface of the handle.

10. The image forming apparatus according to claim 1, further comprising a waste toner tank detachably mountable relative to the main body housing in which the handle is movable and configured to accommodate the rear portion of the handle in the advancing direction when the handle is at the retracted position.

11. The image forming apparatus according to claim 1, further comprising:

a sheet feed unit detachably mountable relative to the main body housing, including a sheet feed roller; and a plurality of corner handles, each of which is provided in the vicinity of four corners of the main body housing, wherein one of the corner handles is provided at a drawing side of the sheet feed unit such that the handle does not interfere with the sheet feed roller.

12. The image forming apparatus according to claim 1, wherein the duplex unit includes a cover configured to cover the pocket when the handle is at the retracted position and opens in association with the sheet reverse unit when the sheet reverse unit is opened.

* * * * *